US008644982B2

(12) United States Patent
Greyshock et al.

(10) Patent No.: US 8,644,982 B2
(45) Date of Patent: Feb. 4, 2014

(54) UNIT DOSE PACKAGING AND ASSOCIATED ROBOTIC DISPENSING SYSTEM AND METHOD

(75) Inventors: Shawn Greyshock, Tarentum, PA (US); Bruce Thompson, Pittsburgh, PA (US)

(73) Assignee: McKesson Automation Inc., Cranberry, PA (US)

( * ) Notice: Subject to any disclaimer, the term of this patent is extended or adjusted under 35 U.S.C. 154(b) by 958 days.

(21) Appl. No.: 12/570,472

(22) Filed: Sep. 30, 2009

(65) Prior Publication Data

US 2011/0077771 A1 Mar. 31, 2011

(51) Int. Cl.
*G06F 7/00* (2006.01)

(52) U.S. Cl.
USPC ..... 700/216

(58) Field of Classification Search
USPC ..... 700/214, 216
See application file for complete search history.

(56) References Cited

U.S. PATENT DOCUMENTS

| | | | |
|---|---|---|---|
| 4,717,042 | A | 1/1988 | McLaughlin |
| 4,785,969 | A | 11/1988 | McLaughlin |
| 4,847,764 | A | 7/1989 | Halvorson |
| 5,014,875 | A | 5/1991 | McLaughlin et al. |
| 5,190,185 | A | 3/1993 | Blechl |
| 5,314,243 | A | 5/1994 | McDonald et al. |
| 5,346,297 | A | 9/1994 | Colson, Jr. et al. |
| 5,377,864 | A | 1/1995 | Blechl et al. |
| 5,405,048 | A | 4/1995 | Rogers et al. |
| 5,431,299 | A | 7/1995 | Brewer et al. |
| 5,460,294 | A | 10/1995 | Williams |
| 5,468,110 | A | 11/1995 | McDonald et al. |
| 5,480,062 | A | 1/1996 | Rogers et al. |
| 5,520,450 | A | 5/1996 | Colson, Jr. et al. |
| 5,564,803 | A | 10/1996 | McDonald et al. |
| 5,593,267 | A | 1/1997 | McDonald et al. |
| 5,661,978 | A | 9/1997 | Holmes et al. |
| D384,578 | S | 10/1997 | Wangu et al. |
| 5,713,485 | A | 2/1998 | Liff et al. |
| 5,716,114 | A | 2/1998 | Holmes et al. |
| 5,745,366 | A | 4/1998 | Higham et al. |
| 5,761,877 | A | 6/1998 | Quandt |
| 5,797,515 | A | 8/1998 | Liff et al. |
| 5,805,456 | A | 9/1998 | Higham et al. |

(Continued)

OTHER PUBLICATIONS

UDL Laboratories, Inc., *Product Packaging—Robot-Rx™ Ready*, <http://www.udllabs.com/product_packaging/robot.aspx> (visited Sep. 3, 2009).

(Continued)

*Primary Examiner* — Ramya Burgess
(74) *Attorney, Agent, or Firm* — Alston & Bird LLP

(57) ABSTRACT

A unit dose package is provided that facilitates the automated picking of the package. The unit dose package includes a plurality of individually packaged unit dose medications separated by perforations. The unit dose package also defines a hole that may be located along at least one perforation, such as at an intersection of at least two perforations, to permit the package to be stored by being suspended by a rod. A robotic dispensing system and method are also provided that facilitate the selective dispensation of unit dose packages having different numbers of individually packaged unit dose medications. The system includes first and second storage locations for storing first and second unit dose packages which have different numbers of individually packaged unit dose medication(s). The system also includes a controller to direct picking of the first or second unit dose packages dependant upon a requested number of individually packaged unit dose medication(s).

20 Claims, 6 Drawing Sheets

(56) References Cited

U.S. PATENT DOCUMENTS

| | | | |
|---|---|---|---|
| 5,842,976 | A | 12/1998 | Williamson |
| 5,878,885 | A | 3/1999 | Wangu et al. |
| 5,880,443 | A | 3/1999 | McDonald et al. |
| 5,883,806 | A | 3/1999 | Meador et al. |
| 5,893,697 | A | 4/1999 | Zini et al. |
| 5,905,653 | A | 5/1999 | Higham et al. |
| 5,912,818 | A | 6/1999 | McGrady et al. |
| 5,927,540 | A | 7/1999 | Godlewski |
| 5,940,306 | A | 8/1999 | Gardner et al. |
| 5,971,593 | A | 10/1999 | McGrady |
| 6,003,006 | A | 12/1999 | Colella et al. |
| 6,011,999 | A | 1/2000 | Holmes |
| 6,021,392 | A | 2/2000 | Lester et al. |
| 6,039,467 | A | 3/2000 | Holmes |
| 6,065,819 | A | 5/2000 | Holmes et al. |
| 6,068,156 | A | 5/2000 | Liff et al. |
| 6,109,774 | A | 8/2000 | Holmes et al. |
| 6,112,502 | A | 9/2000 | Frederick et al. |
| 6,116,461 | A | 9/2000 | Broadfield et al. |
| 6,151,536 | A | 11/2000 | Arnold et al. |
| 6,170,230 | B1 | 1/2001 | Chudy et al. |
| 6,173,212 | B1 | 1/2001 | Valerino |
| 6,176,392 | B1 | 1/2001 | William et al. |
| 6,189,727 | B1 | 2/2001 | Shoenfeld |
| 6,223,934 | B1 | 5/2001 | Shoenfeld |
| 6,256,967 | B1 | 7/2001 | Hebron et al. |
| 6,283,322 | B1 | 9/2001 | Liff et al. |
| 6,289,656 | B1 | 9/2001 | Wangu et al. |
| 6,338,007 | B1 | 1/2002 | Broadfield et al. |
| 6,339,732 | B1 | 1/2002 | Phoon et al. |
| 6,361,263 | B1 | 3/2002 | Dewey et al. |
| 6,370,841 | B1 | 4/2002 | Chudy et al. |
| 6,449,927 | B2 | 9/2002 | Hebron et al. |
| 6,471,089 | B2 | 10/2002 | Liff et al. |
| 6,497,342 | B2 | 12/2002 | Zhang et al. |
| 6,499,270 | B2 | 12/2002 | Peroni et al. |
| 6,532,399 | B2 | 3/2003 | Mase |
| 6,564,121 | B1 | 5/2003 | Wallace et al. |
| 6,581,798 | B2 | 6/2003 | Liff et al. |
| 6,609,047 | B1 | 8/2003 | Lipps |
| 6,611,733 | B1 | 8/2003 | De La Huerga |
| 6,625,952 | B1 | 9/2003 | Chudy et al. |
| 6,640,159 | B2 | 10/2003 | Holmes et al. |
| 6,650,964 | B2 | 11/2003 | Spano, Jr. et al. |
| 6,671,579 | B2 | 12/2003 | Spano, Jr. et al. |
| 6,681,149 | B2 | 1/2004 | William et al. |
| 6,742,671 | B2 | 6/2004 | Hebron et al. |
| 6,755,931 | B2 | 6/2004 | Vollm et al. |
| 6,760,643 | B2 | 7/2004 | Lipps |
| 6,776,304 | B2 | 8/2004 | Liff et al. |
| 6,785,589 | B2 | 8/2004 | Eggenberger et al. |
| 6,790,198 | B1 | 9/2004 | White et al. |
| 6,814,254 | B2 | 11/2004 | Liff et al. |
| 6,814,255 | B2 | 11/2004 | Liff et al. |
| 6,847,861 | B2 | 1/2005 | Lunak et al. |
| 6,874,684 | B1 | 4/2005 | Denenberg et al. |
| 6,892,780 | B2 | 5/2005 | Vollm et al. |
| 6,895,304 | B2 | 5/2005 | Spano, Jr. et al. |
| 6,975,922 | B2 | 12/2005 | Duncan et al. |
| 6,985,797 | B2 | 1/2006 | Spano, Jr. et al. |
| 6,996,455 | B2 * | 2/2006 | Eggenberger et al. ..... 700/231 |
| 7,010,389 | B2 | 3/2006 | Lunak et al. |
| 7,014,063 | B2 | 3/2006 | Shows et al. |
| 7,016,766 | B2 | 3/2006 | William et al. |
| 7,040,504 | B2 | 5/2006 | Broadfield et al. |
| 7,052,097 | B2 | 5/2006 | Meek, Jr. et al. |
| 7,072,737 | B2 | 7/2006 | Lunak et al. |
| 7,072,855 | B1 | 7/2006 | Godlewski et al. |
| 7,077,286 | B2 | 7/2006 | Shows et al. |
| 7,085,621 | B2 | 8/2006 | Spano, Jr. et al. |
| 7,092,796 | B2 | 8/2006 | Vanderveen |
| 7,093,755 | B2 | 8/2006 | Jordan et al. |
| 7,100,792 | B2 | 9/2006 | Hunter et al. |
| 7,103,419 | B2 | 9/2006 | Engleson et al. |
| 7,111,780 | B2 | 9/2006 | Broussard et al. |
| 7,139,639 | B2 | 11/2006 | Broussard et al. |
| 7,150,724 | B2 | 12/2006 | Morris et al. |
| 7,171,277 | B2 | 1/2007 | Engleson et al. |
| 7,218,231 | B2 | 5/2007 | Higham |
| 7,228,198 | B2 | 6/2007 | Vollm et al. |
| 7,249,688 | B2 | 7/2007 | Hunter et al. |
| 7,348,884 | B2 | 3/2008 | Higham |
| 7,417,729 | B2 | 8/2008 | Greenwald |
| 7,419,133 | B2 | 9/2008 | Clarke et al. |
| 7,426,425 | B2 | 9/2008 | Meek, Jr. et al. |
| 7,554,449 | B2 | 6/2009 | Higham |
| 7,571,024 | B2 | 8/2009 | Duncan et al. |
| 7,588,167 | B2 | 9/2009 | Hunter et al. |
| 2004/0158507 | A1 | 8/2004 | Meek et al. |
| 2007/0262147 | A1 | 11/2007 | Braun et al. |

OTHER PUBLICATIONS

UDL Laboratories, Inc., *Product Packaging—Punch Card*, <http://www.udllabs.com/product_packaging/punch_card.aspx> (visited Sep. 3, 2009).

Canadian Office Action for Application No. 2,716,102, dated Jul. 8, 2013.

Canadian Office Action for Application No. 2,716,102, dated Nov. 20, 2013.

* cited by examiner

UNIT DOSE PACKAGING AND ASSOCIATED ROBOTIC DISPENSING SYSTEM AND METHOD

TECHNOLOGICAL FIELD

Embodiments of the present invention relate generally to unit dose packages and, more particularly, to unit dose packages and associated robotic dispensing systems and methods that facilitate the automated dispensation of a unit dose package.

BACKGROUND

Medications and, in particular, oral solid medications, are packaged in a variety of manners. One type of packaging that has become popular, both in retail consumer settings and within hospitals and other healthcare facilities, is a unit dose blister pack. A unit dose blister pack includes a backing member and a blister mounted upon the backing member and defining a cavity for storing a medication. Typically, a single dose of medication is stored within the cavity, such as by storing a single pill within a cavity. Unit dose blister packs have become popular for a variety of reasons, including the ease or readiness with which a medication dispensed in a unit dose blister pack can be administered. Additionally, unit dose blister packs may provide smaller and/or less expensive packaging than that available for medications packaged by a pharmacy.

One approach for dispensing medication within a hospital or other healthcare facility involves the use of automated dispensing cabinets located throughout the facility. These automated dispensing cabinets are stocked by a pharmacy, typically with a wide variety of medications. Nurses or other healthcare professionals may then access the automated dispensing cabinets in a secure manner in order to withdraw medications prescribed for patients, many of which are generally located in the vicinity of the automated dispensing cabinet.

Unit dose blister packs are stocked in automated dispensing cabinets since the unit dose blister packs provide for efficient storage of the various medications. Typically, complete unit dose blister pack cards are provided by the pharmacy and stocked by the automated dispensing cabinets. A full unit dose blister card includes a plurality of unit dose blister packs connected, such as by means of perforations, to form an integral card. In order to administer the medication of a unit dose pack to a patient, a nurse or other healthcare professional must generally separate a unit dose blister pack from the remainder of the unit dose blister card, with the remainder of the unit dose blister card remaining within the automated dispensing cabinet. Although it is generally preferred by a nurse or other healthcare professional to retrieve a singulated unit dose blister pack from an automated dispensing cabinet in comparison to taking the additional time required to separate a unit dose blister pack from the remainder of the unit dose blister card, unit dose blister cards are generally stocked within automated dispensing cabinets since the unit dose blister cards are generally easier to pick within the pharmacy and may assist with inventory management.

With regard to the picking of unit dose blister cards within the pharmacy, the unit dose blister cards are generally picked manually since automated or robotic dispensation systems generally provide for the dispensation of unit dose medications only in instances in which the unit dose medications have been over-bagged. It has also been observed in instances in which individually packaged unit dose medications, such as singulated unit dose blister packs or over-bagged unit dose medications, are available to be picked that a plurality of individually packaged unit dose medications must frequently be selected in order to fill an order requiring two, three or more doses of the medications, thereby necessitating multiple pick operations. Although the multiple pick operations required to dispense a plurality of individually packaged unit dose medications might suggest that unit dose blister cards containing multiple unit dose blister packs would be more favored, the number of unit dose blister packs that is dispensed for a single patient is generally much fewer than the number of unit dose blister packs included within a unit dose blister card. For example, it may be somewhat common to dispense two unit dose blister packs for the same patient, but not the ten unit dose blister packs that may be included within a single unit dose blister card.

As such, it may be desirable to provide an improved system and method for automatically dispensing unit dose packages in order to, for example, reduce the number of pick operations and to increase the relative efficiency with which the unit dose packages are dispensed.

BRIEF SUMMARY

According to embodiments to the present invention, a unit dose package is provided that facilitates the robotic or automated picking and dispensation of the unit dose package. As such, the unit dose package of embodiments of the present invention permits a plurality of individually packaged unit dose medications to be dispensed in a single pick operation so as to increase the relative efficiency of the pick process. According to other embodiments of the present invention, a robotic dispensing system and method are provided that facilitate the selective dispensation of unit dose packages having different numbers of individually packaged unit dose medications, thereby further increasing the efficiency of the pick process.

A robotic dispensing system of one embodiment is provided that includes a unit dose package having a plurality of individually packaged unit dose medications. Each of the individually packaged unit dose medications is separably connected to at least one other individually packaged unit dose medication such that the plurality of individually packaged unit dose medications are separably interconnected. The robotic dispensing system also includes a storage location for storing at least one unit dose package having a plurality of individually packaged unit dose medications, and a controller configured to direct picking of the unit dose package. Each individually packaged unit dose medication may include indicia, such as a barcode, for identifying the medication. In this regard, each individually packaged unit dose medication of the unit dose package may include different indicia for individually identifying the respective individually packaged unit dose medications.

According to one embodiment, a unit dose blister card is provided that includes a plurality of unit dose blister packs. Each unit dose blister pack includes a backing member and a blister defining a cavity for storing a medication. Each of the plurality of unit dose blister packs is connected to at least one other unit dose blister pack such that the plurality of unit dose blister packs are interconnected. The unit dose blister card of this embodiment also includes a plurality of perforations defined between neighboring unit dose blister packs to facilitate separation of the unit dose blister packs. The unit dose blister card of this embodiment also defines a hole along at least one perforation such that the at least one perforation is aligned with the hole. In one embodiment, the hole is defined at an intersection of at least two perforations.

The unit dose blister card of one embodiment extends lengthwise between opposed ends and widthwise between opposed sides. In this embodiment, the hole may be defined to be closer to one end than another end and to be centered between the opposed sides. The unit dose blister card of one embodiment may also include indicia, such as a bar code, carried by each unit dose blister pack for identifying the medication. In this embodiment, the hole may be positioned so as to be spaced from the indicia carried by each unit dose blister pack.

In another embodiment, a robotic dispensing system is provided that includes a first storage location for storing at least one first unit dose package having a first predetermined number of individually packaged unit dose medication(s), such as a single unit dose medication. The robotic dispensing system of this embodiment also includes a second storage location for storing at least one second unit dose package having a second predetermined number of individually packaged unit dose medications with the second predetermined number being different than the first predetermined number. At least one of the first and second unit dose packages has a plurality of individually packaged unit dose medications that are configured such that each individually packaged unit dose medication is connected to at least one other individually packaged unit dose medication such that a plurality of individually packaged unit dose medications are interconnected. For example, the second unit dose package may include a plurality of interconnected, individually packaged unit dose medications, while the first unit dose blister card may have only a single unit dose medication. The robotic dispensing system of this embodiment also includes a controller configured to direct picking of the first unit dose package or the second unit dose package dependant upon a requested number of individually packaged unit dose medication(s).

The first and second storage locations may include first and second rods, respectively. In this embodiment, the first and second unit dose packages may each define a hole configured to receive the first and second rods, respectively. Additionally, the second rods may be spaced apart from neighboring rods by a greater distance than a distance by which the first rods are spaced apart from neighboring rods, thereby accommodating unit dose blister cards having different sizes.

Each individually packaged unit dose medication of one embodiment includes indicia, such as a bar code, for identifying the medication. In this instance, each individually packaged unit dose medication of a second unit dose package may include different indicia for individually identifying the respective unit dose medication. In one embodiment, the indicia associated with the at least one second unit dose package is different than the indicia associated with the at least one first unit dose package so as to differentiate the different packages.

In accordance with a further embodiment, a method of dispensing medication is provided that includes storing at least one first unit dose package having a first predetermined number of individually packaged unit dose medication(s) at a first storage location and storing at least one second unit dose package having a second predetermined number of individually packaged unit dose medications at a second storage location. The second predetermined number is different than the first predetermined number. For example, the first unit dose package may include only a single, individually packaged unit dose medication, while the second unit dose package may include a plurality of individually packaged unit dose medications. At least one of the first and second unit dose packages has a plurality of individually packaged unit dose medications that are configured so that each individually packaged unit dose medication is connected to at least one other individually packaged unit dose medication such that the plurality of individually packaged unit dose medications are interconnected. The method of this embodiment also directs picking of the first unit dose package or the second unit dose package dependent upon a requested number of individually packaged unit dose medication(s).

In one embodiment in which the first and second storage locations include first and second rods, respectively, the first and second unit dose packages each define that hole configured to receive a respective rod. In this embodiment, the method also includes spacing the second rods apart from neighboring rods by a greater distance than the distance by which the first rods are spaced apart from neighboring rods to accommodate the differently sized packages.

The method of one embodiment identifies each individually packaged unit dose medication based upon indicia, such as a barcode, carried by each unit dose medication. In this regard, the method of one embodiment identifies the medication by individually identifying the respective individually packaged unit dose medications of a second unit dose package based upon the different indicia of each individually packaged unit dose medication of the second unit dose package. In one embodiment, the indicia associated with a second unit dose package is different than the indicia associated with the first unit dose package, thereby permitting a different unit dose package to be distinguished.

BRIEF DESCRIPTION OF THE SEVERAL VIEWS OF THE DRAWING(S)

Having thus described embodiments of the invention in general terms, reference will now be made to the accompanying drawings, which are not necessarily drawn to scale, and wherein:

DETAILED DESCRIPTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
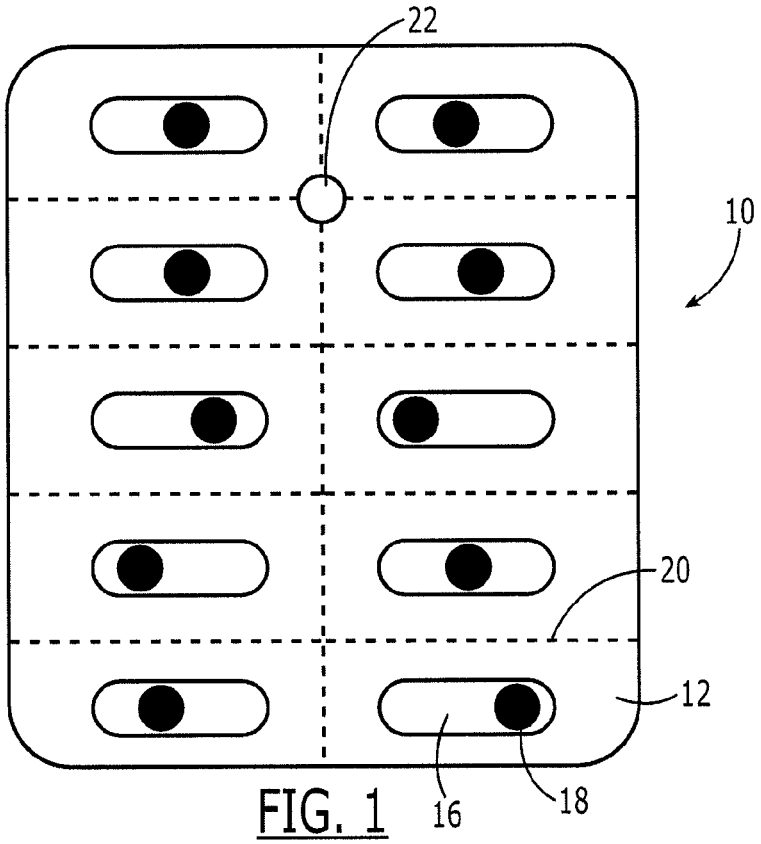
FIG. 1 depicts a first side of a unit dose blister card in accordance with one embodiment of the present invention.

Referring now to FIG. 1, a unit dose package in accordance with one embodiment of the present invention is depicted in the form of a unit dose blister card 10. The unit dose blister card includes a plurality of unit dose blister packs 12. Each unit dose blister pack includes a backing member 14 and a blister 16 defining a cavity for storing the medication 18. Typically, each unit dose blister pack of a unit dose blister card stores the same medication in the same dosage. For example, each unit dose blister pack may store a single pill or other oral solid medication. Each unit dose blister pack of the unit dose blister card is connected to at least one other unit dose blister pack of the unit dose blister card. As such, the plurality of unit dose blister packs of a unit dose blister card are interconnected.

The unit dose package may include perforations defined between the individually packaged unit dose medications to permit separation of the individual medications. For example, a unit dose blister card 10, such as that shown in FIG. 1, includes a plurality of perforations 12 defined between neighboring unit dose blister packs 12 to facilitate separation of the unit dose blister packs. In the illustrated embodiment, the unit dose blister card includes 10 unit dose blister packs arranged in a 2×5 card having two columns of unit dose blister packs with each column having five unit dose blister packs. As shown, the unit dose blister card of this embodiment includes a perforation between each column of unit dose blister packs as well as between each adjacent unit dose blister pack 11 within a respective column. As such, individual unit dose blister packs may be separated along the perforations from the remainder of the unit dose blister card. While a 2×5 unit dose blister card is depicted, the unit dose blister card may include any number of unit dose blister packs and may be arranged in any configuration of interconnected unit dose blister packs without departing from the spirit and scope of the present invention.

Figure 2:
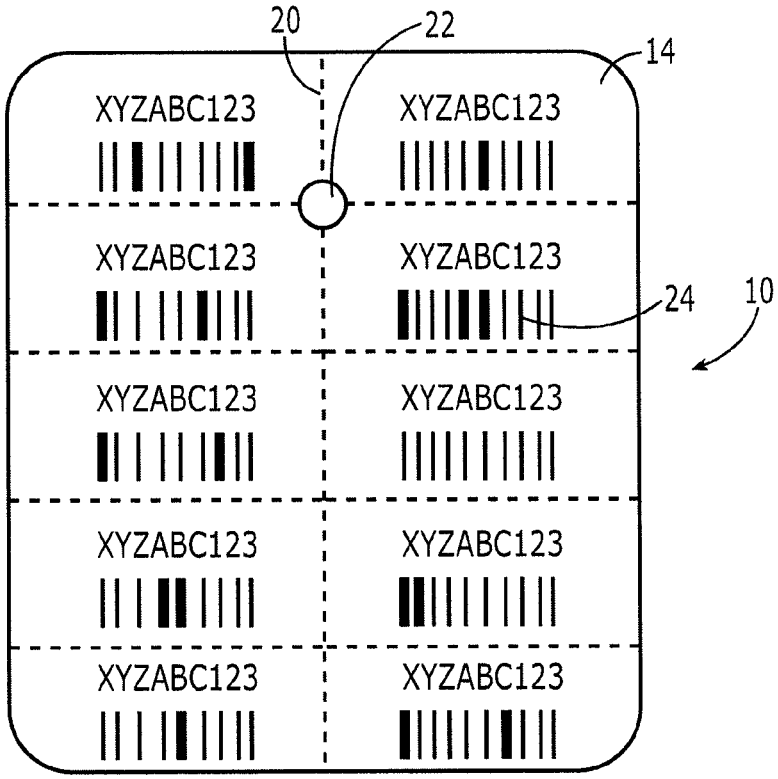
FIG. 2 depicts a second side of the unit dose blister card of FIG. 1.

In order to facilitate the automated dispensation of the unit dose packages, such as by robotic dispensing system as discussed below, the unit dose package also includes a hole 22. The hole may be defined at various locations within the unit dose package but, in the illustrated embodiment, is defined along at least one perforation 20 such that the at least one perforation is aligned with the hole. By being aligned with the hole, the line or path along which the perforation extends also extends through the hole such that the perforation would extend through that portion of the unit dose blister card from which the hole is defined in the absence of the hole. As shown in FIGS. 1 and 2, the unit dose blister card of one embodiment defines the hole to be located at an intersection of at least two perforations. In the illustrated embodiment, the hole is defined by the unit dose blister card such that the line or path along which each perforation extends passes through the center point of the hole. However, in other embodiments, the line or path along which each perforation extends need not extend through the center point of the hole, but may, instead, extend through any portion of the hole.

Figure 3:
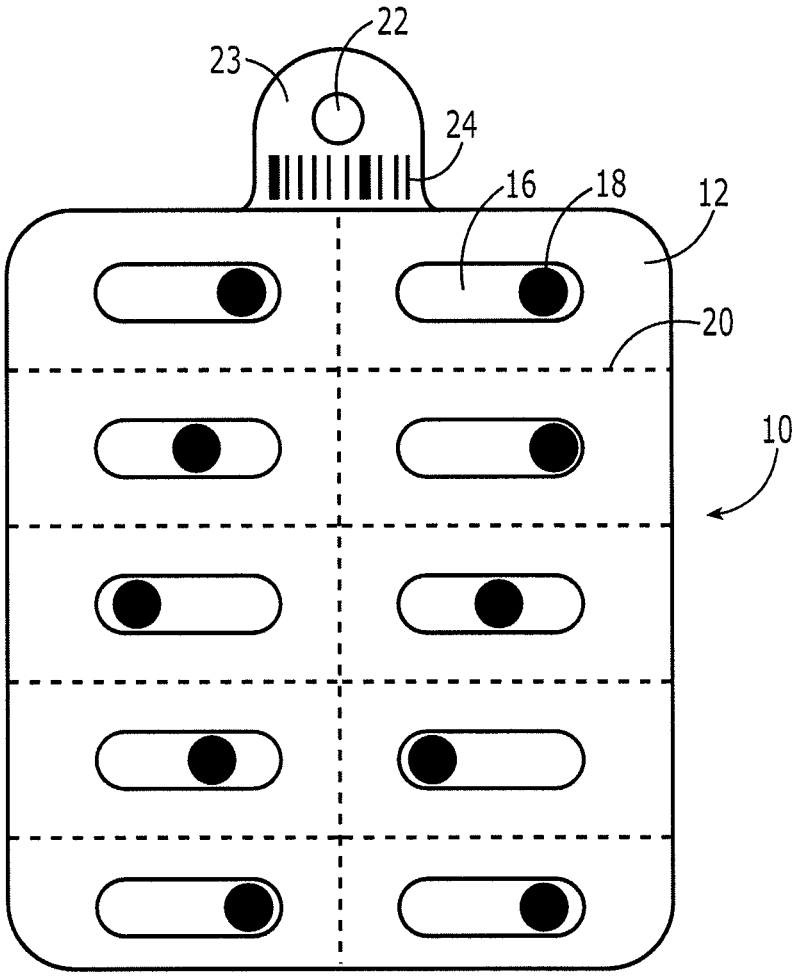
FIG. 3 depicts a unit dose blister card having a hook in accordance with one embodiment of the present invention.

As noted above, the hole 22 need not necessarily be located in an aligned relationship with at least one perforation, but may be located elsewhere within a blister card 10. Alternatively, the unit dose package, such as a unit dose blister card 10, may include a hook, hanger or the like that extends outwardly from the remainder of the package and that defines a hole. The hole may be either fully defined by the hook, hanger or the like or may be partially defined by the hook, hanger or the like 23 as shown in FIG. 3.

Each individually packaged unit dose medication of a unit dose package may include indicia, such as a barcode, for identifying the medication. As shown in FIG. 2, for example, each unit dose blister pack 12 of a unit dose blister card 10 may include indicia 24, such as a barcode, for identifying the medication 18. Although the indicia may be imprinted upon the unit dose blister pack, such as the backing member 14, in a variety of positions, the indicia is generally spaced somewhat from the edges of the unit dose blister pack so as to reduce the risk that the perforations 20 will cut through or otherwise obstruct the indicia. As it is desirable that the hole 22 defined by the unit dose blister card also avoids destroying or otherwise obstructing any portion of the indicia, the unit dose blister card of one embodiment advantageously defines the hole along at least one perforation, such as that the intersection of at least two perforations, so as to space the hole from the indicia and thereby avoid any destruction or obstruction of the indicia by the hole. In embodiments that include a hook, hanger or the like 23, the hook, hanger or the like may also include indicia, such as a barcode, identifying the medication carried by the unit dose package.

Figure 4:
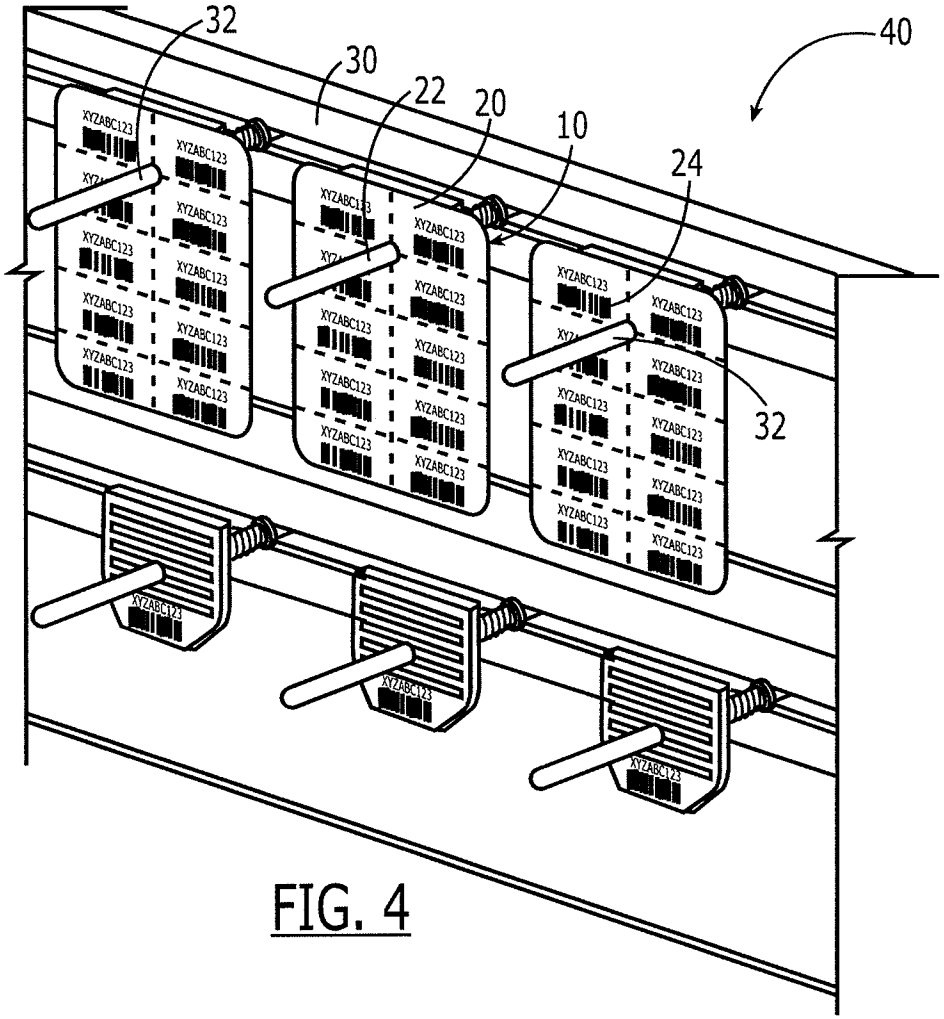
FIG. 4 is a perspective view of a rack for storing unit does blister cards in accordance with one embodiment of the present invention.

By defining a hole 22, a unit dose package, such as a unit dose blister card 10, may be stored in a predefined accessible manner within an automated dispensing system. As shown in FIG. 4, for example, a robotic dispensing system 40 may include storage locations for storing unit dose blister cards. In this regard, a robotic dispensing system may include a rack 30 or other structure having a plurality of rods 32 with each rod defining a respective storage location. As shown in FIG. 4, the unit dose blister packs may be mounted upon the respective rods such that the rod extends through the hole defined by each unit dose blister card. As described below, since a unit dose blister card may be somewhat larger than other medications stored by a robotic dispensing system, the rods may need to be spaced further apart such that the unit dose blister packs may be mounted thereupon without contacting or otherwise obstructing the medications stored upon the neighboring rods.

Figure 5:
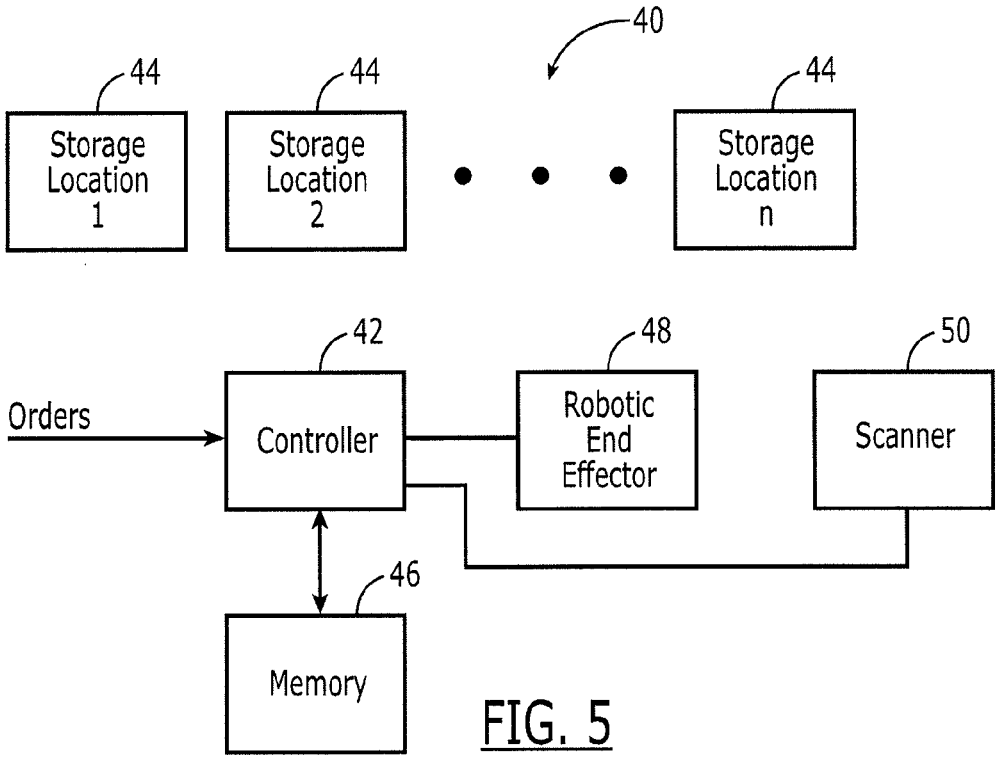
FIG. 5 is a block diagram of a robotic dispensing system in accordance with one embodiment of the present invention.

In addition to the storage locations, the robotic dispensing system 40 may include a controller 42 configured to direct the picking of medications from respective storage locations 44 within the dispensing system, as shown in FIG. 5. The controller may be embodied in various forms including a processor, a computer, a workstation or a variety of other computing devices. The controller may receive a listing of medications to be picked, such as from another computer, e.g., a pharmacy computer system, for a particular patient, for restocking a medication cabinet or otherwise. The robotic dispensing system may also include a storage device 46, such as volatile and/or non-volatile memory. The storage device may be configured to store information, data, applications, instructions or the like to enable the robotic dispensing system to carry out various functions in accordance with exemplary embodiments of the present invention. For example, the storage device could be configured to store instructions for execution by the controller to direct the operations of the controller. Additionally, the storage device may include one or more databases that may store a variety of files, contents or datasets. For example, the storage device may include a database that defines the storage location for each medication within the dispensing system. Based upon the listing of medications to be picked and their respective storage locations, the controller may then direct an end effector 48 or the like to pick each of the medications and to place each of the medications in a bin or other container for delivery to a user.

In order to ensure that the appropriate medications are dispensed, the robotic dispensing system 40 may also include a scanner 50 or other reader for reading the indicia 24 carried by the medication that is picked. The scanner may be provided in various manners. For example, the scanner may be carried by the end effector 48 so as to read the indicia proximate the time of picking. Alternatively, the scanner may be separate from the end effector such that the end effector transports the picked medication to the scanner to read the indicia. The scanner or other reader may provide a representation of the indicia to the controller 42 for confirmation that the medication identified by the indicia is, in fact, the medication that is intended to be picked and, if not, to alert the user or system operator.

In accordance with one embodiment of the present invention, the robotic dispensing system 40 may be configured to pick the medications 18 that are desired for restocking medication cabinets, such as automated dispensing cabinets. In this regard, the robotic dispensing system may include storage locations 44, including a first storage location, for storing one or more unit dose packages. In one embodiment, the first storage location may be defined by a first rod with the first rod extending through the holes 22 defined by the unit dose blister cards as shown in FIG. 4. In order to facilitate the manner in which a unit dose blister card is carried by a respective rod, the unit dose blister card may define the hole at a predetermined position not only with respect to the perforations 20, but also with respect to the card itself. In this regard, a unit dose blister card generally extends lengthwise between opposed edges and widthwise between opposed sides. As shown in FIGS. 1, 2 and 4, the hole of a unit dose blister card may be defined to be closer to one end than another end and may be centered between the opposed sides. As such, the unit dose blister card of this embodiment will generally be carried by a rod in the manner shown in FIG. 4 so as to facilitate the picking of the unit dose blister card in a repeatable manner. However, the hole of a unit dose package may be defined at other locations and may be defined by a hook, hanger or the like in other embodiments.

In instances in which the request or order includes one or more of the unit dose packages, such as one or more unit dose blister cards 10 in the embodiment of FIG. 4, the controller may direct an end effector 48 or the like to the first storage location 44 in order to engage a unit dose blister card, such as by means of vacuum or suction, and remove the unit dose blister card from the rod. The controller may then direct the end effector or the like to position the unit dose blister card proximate a scanner 50 or reader such that the scanner or reader can read the indicia 24 carried by one or more of the unit dose blister packs 12 of the unit dose blister card. The controller can then confirm that the unit dose blister card includes unit dose blister packs storing the desired medication prior to dispensing the unit dose blister card. By configuring the unit dose blister card such that unit dose blister card may be stored within a robotic dispensing system 40 and automatically dispensed, the restocking of medication cabinets, such as automatic dispensing cabinets, may be performed more efficiently since entire unit dose blister cards may be automatically dispensed.

Figure 6:
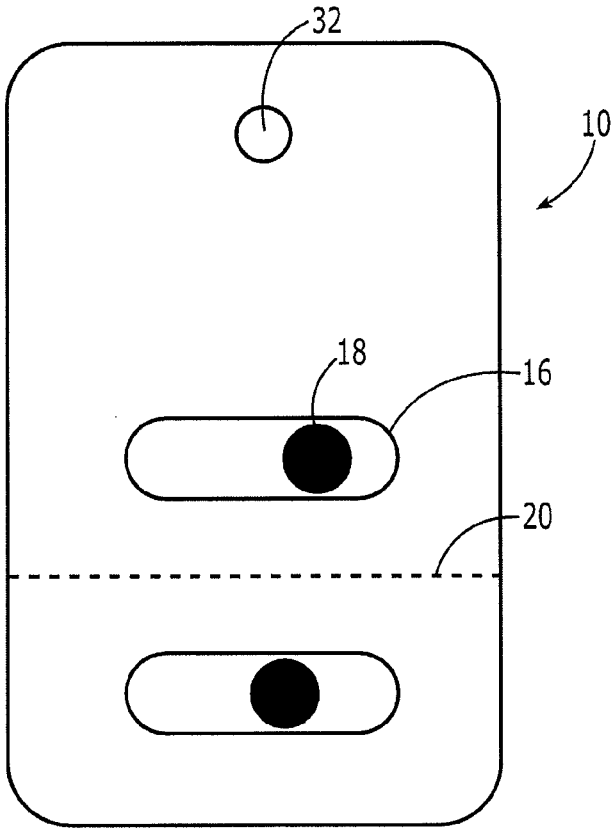
FIG. 6 depicts a unit dose blister card having a pair of unit dose blister packs in accordance with one embodiment of the present invention.
Figure 7:
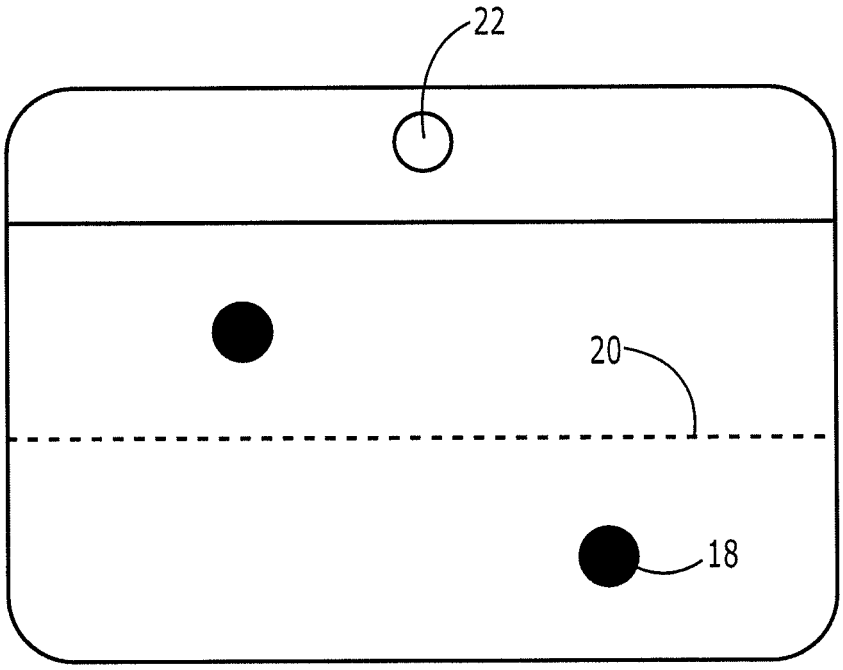
FIG. 7 depicts a unit dose package having a pair of overbagged medications in accordance with one embodiment of the present invention.

In addition or instead of restocking automated dispensing cabinets, robotic dispensing systems 40 may be utilized to fill orders for individual patients. In these instances, the robotic dispensing system may be called upon to dispense smaller quantities of a medication 18, such as singulated unit dose blister packs 12, pairs of unit dose blister packs or the like. In order to facilitate the automated dispensation of these quantities, unit dose packages having different numbers of individually packaged unit dose medications may be provided and stored within a robotic dispensing system. As shown in FIG. 6, for example, a unit dose blister card having two unit dose blister packs separated by a perforation 20 may be provided to service those instances in which a patient order calls for two doses of the medication. As shown in FIG. 6, the unit dose blister card may include a tab at one end of the card which defines a hole 22 for receiving a respective rod in order to store the unit dose blister card within a robotic dispensing system. In another embodiment shown in FIG. 7, a unit dose package may include two or more over-bagged medications with each individually packaged medication connected to another individually packaged medication by a perforation. As such, the robotic dispensing system of one embodiment may include unit dose packages having different numbers of over-bagged medications.

In one embodiment, the robotic dispensing system 40 is stocked with unit dose packages having the same medication 18, but in different quantities with the number of individually packaged unit dose medications of each unit dose package being selected, for example, based upon the most common quantities of the medication that are ordered. By way of example, a robotic dispensing system of one embodiment may include first unit dose blister cards having only a single unit dose blister pack and second unit dose blister cards having a plurality of unit dose blister packs, such as a pair of unit dose blister packs as shown in FIG. 6. However, the unit dose blister cards may have other numbers of unit dose blister packs, if so desired.

Figure 8:
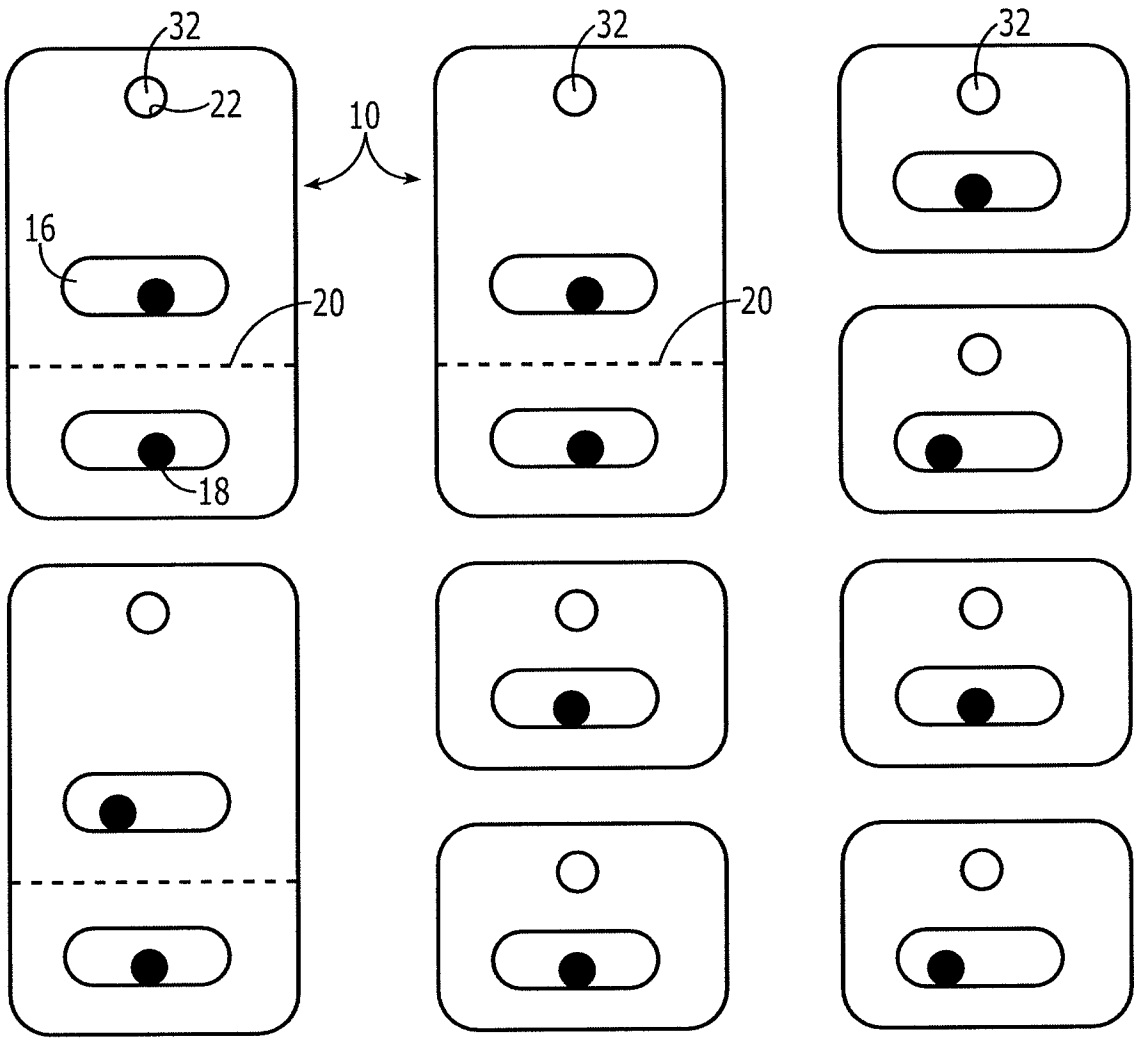
FIG. 8 is a perspective view of a rack for storing two different types of unit dose blister cards including the unit dose blister card of FIG. 6 in accordance with one embodiment of the present invention.

In one embodiment depicted in FIG. 8, one or more first unit dose blister cards having a first predetermined number of unit dose blister pack(s) are stored at a first location, such as by being hung from a respective rod. Additionally, one or more second unit dose blister cards having a second predetermined number of unit dose blister packs are stored at a second storage location, such as by being hung from a second rod. In response to orders for the medication, a controller 42 may direct the picking of the first unit dose blister card or the second unit dose blister card depending upon the quantity of the medication that is requested. In the embodiment in which the first unit dose blister card has only a single unit dose blister pack and the second unit dose blister card has a pair of unit dose blister packs, an order requesting two doses of the medication will cause the controller to direct the picking of a second unit dose blister card so as to provide both doses of the medication with a single pick operation. Alternatively, if the order had requested one dose of the medication, the controller would have directed the picking of a first unit dose blister card so as to provide the requested dosage. Depending upon the quantity of a medication request, the controller may direct the picking of both at least one first unit dose blister card and at least one second unit dose blister card, such as in an instance in which three doses of the medication are requested with the controller directing the picking of both a first unit dose blister card and a second unit dose blister card.

As described above, each individually packaged unit dose medication may include indicia 24, such as a barcode, for identifying the medication 18 and the robotic dispensing system 40 may also include a scanner 50 or reader for reading the indicia carried by the individually packaged unit dose medication of a unit dose package that has been picked in order to confirm that the proper medication has been picked prior to its dispensation. For example, although the first and second unit dose blister cards 10 of the above-described embodiment contain the same medication, the first and second unit dose blister cards may include different indicia with the indicia representative not only of the type of medication, but also the quantity of medication provided by the respective unit dose blister card. Further, in instances in which a unit dose package includes a plurality of individually packaged unit dose medications, the indicia carried by each individually packaged unit dose medication may differ from one another so as to not only identify the type of medication, but also to individually identify each individually packaged unit dose medication of a unit dose package. By individually identifying each individually packaged unit dose medication, the medication can be readily identified in the event that any of the medication is returned after having been singulated by a nurse or the like on the floor.

As shown in FIG. 8, the storage locations of a robotic dispensing system 40 may be configured depending upon the size of each unit dose package. In this regard, a unit dose blister card 10 of the type shown in FIG. 6 that includes a pair of unit dose blister packs is generally larger than a unit dose blister card having only a single unit dose blister pack. As such, in instances in which the storage locations 44 include respective rods upon which the unit dose packages are hung, the rods may be spaced based upon the relative size of the unit dose packages that will be carried by the respective rods. In this regard, the rod that will carry the unit dose package having a plurality of individually packaged unit dose medications may be spaced further apart from one another than the rods carrying the unit dose package having only a single individually packaged unit dose medication.

By including unit dose packages having different quantities of individually packaged unit dose medications, however, a robotic dispensing system 40 may more efficiently pick and dispense the requested medication 18 by reducing the number of pick operations required to retrieve the same quantity of medication. As such, not only may unit packages be dispensed automatically in accordance with embodiments of the present invention, but a robotic dispensing system of one embodiment may be configured to dispense individually packaged unit dose medications in an efficient manner by stocking and dispensing unit dose packages having different numbers of individually packaged unit dose medications.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A robotic dispensing system comprising:

a first storage location including a first rod for storing at least one first unit dose package that is hung upon the first rod, each first unit dose package having a first predetermined number of individually packaged unit dose medication(s);

a second storage location including a second rod for storing at least one second unit dose package that is hung upon the second rod, each second unit dose package having a second predetermined number of individually packaged unit dose medications, wherein the second predetermined number is different than the first predetermined number, wherein at least one of the first and second unit dose packages has a plurality of individually packaged unit dose medications that are configured such that each individually packaged unit dose medication is connected to at least one other individually packaged unit dose medication while hung upon the respective rod such that the plurality of individually packaged unit dose medications are interconnected, and wherein the first and second unit dose packages include a same medication; and a controller configured to direct picking of the first unit dose package or the second unit dose package, dependent upon a requested number of unit dose medication (s), so as to remove the first unit dose package or the second unit dose package from the respective rod.

2. A robotic dispensing system according to claim 1 wherein the first and second unit dose packages each define a hole configured to receive a respective rod, and wherein the second rods are spaced apart from neighboring rods by a greater distance than a distance by which the first rods are spaced apart from neighboring rods.

3. A robotic dispensing system according to claim 1 wherein each individually packaged unit dose medication comprises indicia for identifying the medication.

4. A robotic dispensing system according to claim 3 wherein the indicia comprises a barcode.

5. A robotic dispensing system according to claim 3 wherein each individually packaged unit dose medication of a second unit dose package comprises different indicia for individually identifying the respective individually packaged unit dose medications.

6. A robotic dispensing system according to claim 3 wherein the indicia associated with the at least one second unit dose package is different than the indicia associated with the at least one first unit dose package.

7. A robotic dispensing system according to claim 1 wherein the first unit dose package comprises only a single individually packaged unit dose medication, and wherein the second unit dose package comprises a plurality of individually packaged unit dose medications.

8. A robotic dispensing system according to claim 1 wherein the first and second unit dose packages each include at least one of a hook or hanger configured to receive a respective rod.

9. An automated method of dispensing medication comprising:

storing at least one first unit dose package having a first predetermined number of individually packaged unit dose medication(s) at a first storage location by hanging the at least one first unit dose package upon a first rod;

storing at least one second unit dose package having a second predetermined number of individually packaged unit dose medications at a second storage location by hanging the at least one second unit dose package upon a second rod, wherein the second predetermined number is different than the first predetermined number, wherein at least one of the first and second unit dose packages has a plurality of individually packaged unit dose medications that are configured such that each individually packaged unit dose medication is connected to at least one other individually packaged unit dose medication while hung upon the respective rod such that the plurality of individually packaged unit dose medications are interconnected, and wherein the first and second unit dose packages include a same medication; and directing picking, with a controller, of the first unit dose package or the second unit dose package, dependent upon a requested number of individually packaged unit dose medication(s), so as to remove the first unit dose package or the second unit dose package from the respective rod.

10. A method according to claim 9 wherein the first and second unit dose packages each define a hole configured to receive a respective rod, and wherein the method further comprises spacing the second rods apart from neighboring rods by a greater distance than a distance by which the first rods are spaced apart from neighboring rods.

11. A method according to claim 9 further comprising identifying the medication of each individually packaged unit dose medication based upon indicia carried by the individually packaged unit dose medication.

12. A method according to claim 11 wherein the indicia comprises a barcode.

13. A method according to claim 11 wherein identifying the medication comprises individually identifying the respective individually packaged unit dose medications of a second unit dose package based upon the different indicia of each individually packaged unit dose medication of the second unit dose package.

14. A method according to claim 11 wherein the indicia associated with the at least one second unit dose package is different than the indicia associated with the at least one first unit dose package.

15. A method according to claim 9 wherein the first unit dose package comprises only a single individually packaged unit dose medication, and wherein the second unit dose package comprises a plurality of individually packaged unit dose medications.

16. A robotic dispensing system comprising:

a unit dose package comprising a plurality of individually packaged unit dose medications, wherein each of the plurality of individually packaged unit dose medications is separably connected to at least one other individually packaged unit dose medication such that the plurality of individually packaged unit dose medications are separably interconnected;

a storage location for storing at least one unit dose package having a plurality of individually packaged unit dose medications, wherein the storage location includes a rod upon which the at least one unit dose package is hung while the plurality of individually packaged unit dose medications of the at least one unit dose package remain connected;

a controller configured to direct picking of the at least one unit dose package so as to remove the at least one first unit dose package from the rod.

17. A robotic dispensing system according to claim 16 wherein each individually packaged unit dose medication comprises indicia for identifying the medication.

18. A robotic dispensing system according to claim 17 wherein the indicia comprises a barcode.

19. A robotic dispensing system according to claim 17 wherein each individually packaged unit dose medication of the unit dose package comprises different indicia for individually identifying the respective individually packaged unit dose medications.

20. A robotic dispensing system according to claim 16 wherein the unit dose package includes at least one of a hook or hanger configured to receive the rod.

* * * * *